US006336494B1

(12) United States Patent
Dobusch

(10) Patent No.: US 6,336,494 B1
(45) Date of Patent: Jan. 8, 2002

(54) TOOL FOR PRODUCING CASTING CORES

(75) Inventor: Heinz Dobusch, Marbach (DE)

(73) Assignee: Filterwerk Mann & Hummel GmbH, Ludwigsbrug (DE)

( * ) Notice: Subject to any disclaimer, the term of this patent is extended or adjusted under 35 U.S.C. 154(b) by 0 days.

(21) Appl. No.: 09/536,295

(22) Filed: Mar. 27, 2000

Related U.S. Application Data

(63) Continuation-in-part of application No. PCT/EP99/05322, filed on Jul. 26, 1999.

(30) Foreign Application Priority Data

Jul. 25, 1998 (DE) ..... 198 33 598

(51) Int. Cl.[7] ..... B22D 23/00; B22D 17/26; B22D 17/22

(52) U.S. Cl. ..... 164/129; 164/342; 164/347

(58) Field of Search ..... 164/129, 339, 164/137, 342, 131, 132, 347

(56) References Cited

U.S. PATENT DOCUMENTS 4,399,859 A * 8/1983 Marcil ..... 164/342
4,809,763 A * 3/1989 Schilling ..... 164/28

FOREIGN PATENT DOCUMENTS

FR 660049 A * 7/1929
GB 1569382 A * 6/1980
JP 06-218735 A * 8/1994

* cited by examiner

*Primary Examiner*—M. Alexandra Elve
*Assistant Examiner*—Kevin McHenry
(74) *Attorney, Agent, or Firm*—Crowell & Moring LLP

(57) ABSTRACT

A tool, especially for producing molding cores. The tool is disposed in a casting apparatus and is provided with first half-shells (13, 15) and second half-shells (14, 16). Two parting planes are provided, and two casting units are formed from the first and second half-shells. These parting planes are situated one behind the other in the direction of movement of the two casting units.

12 Claims, 5 Drawing Sheets

TOOL FOR PRODUCING CASTING CORES

CROSS REFERENCE TO RELATED APPLICATION

This application is a continuation-in-part of co-pending international application no. PCT/EP99/05322, filed Jul. 26, 1999, designating the United States of America.

BACKGROUND OF THE INVENTION

The invention relates to a tool, especially for producing cores, which is arranged in a casting system and wherein the tool comprises first casting half shells and second casting half shells.

Such tools are used, for example, in the so-called "lost core technique," in which cores of a low-melting metal alloy are cast in the low-pressure process in a multi-part mold. These cores are then placed in a plastic injection molding machine. The plastic part is produced by injecting synthetic resin material around the core into the injection molding die. After the synthetic resin enclosed core has cooled, the core is melted out by applying appropriate fusion heat. For this purpose the plastic part with its enclosed core is immersed in a heated bath and by inductive support a uniform fusion of the core is achieved. The core is produced in a horizontally arranged casting system. Since the core has a relatively large mass, a long cooling phase is necessary. This means that the cycle times are substantially influenced by the cooling times and under some circumstances they are substantially longer than the subsequent cycle times when thermoplastic synthetic resin is injected around the core.

Consequently, until now it has been necessary to have several core casting machines to make it possible to produce a certain number of cores within a certain period of time.

SUMMARY OF THE INVENTION

It is the object of the invention to provide a a tool, especially for the production of cores, which enables shorter cycle times to be achieved.

This and other objects have been achieved in accordance with the present invention by providing a tool which comprises first casting half-shells and second casting half-shells, with two planes of separation or parting planes being provided and two casting units having first and second casting half-shells being formed, in which the parting planes are situated one behind the other in the direction of movement of the two casting units.

A significant advantage of this invention is that at least two cores can simultaneously be cast in parallel in a single core casting machine, and thus the cycling time can be halved.

In one embodiment of the invention it is proposed to couple the casting half shells, which move parallel to one another, together by means of connecting rods. The application of force thus is effected through these connecting rods, and optionally a packet of springs can be provided to compensate for tolerances.

In accordance with another embodiment of the invention, each half shell is equipped with one or more ejectors. The core casting machine can be provided with a plurality of casting units arranged side by side. Thus, for example, four or six cores can be produced in a single working cycle.

To enable the cores to be removed by a gripper, in another embodiment of the invention the tool is moved after the casting operation such that the cores on both sides are released and can be removed.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be explained in further detail hereinafter with reference to illustrative preferred embodiments shown in the accompanying drawings in which.

DETAILED DESCRIPTION OF PREFERRED EMBODIMENTS

Figure 1:
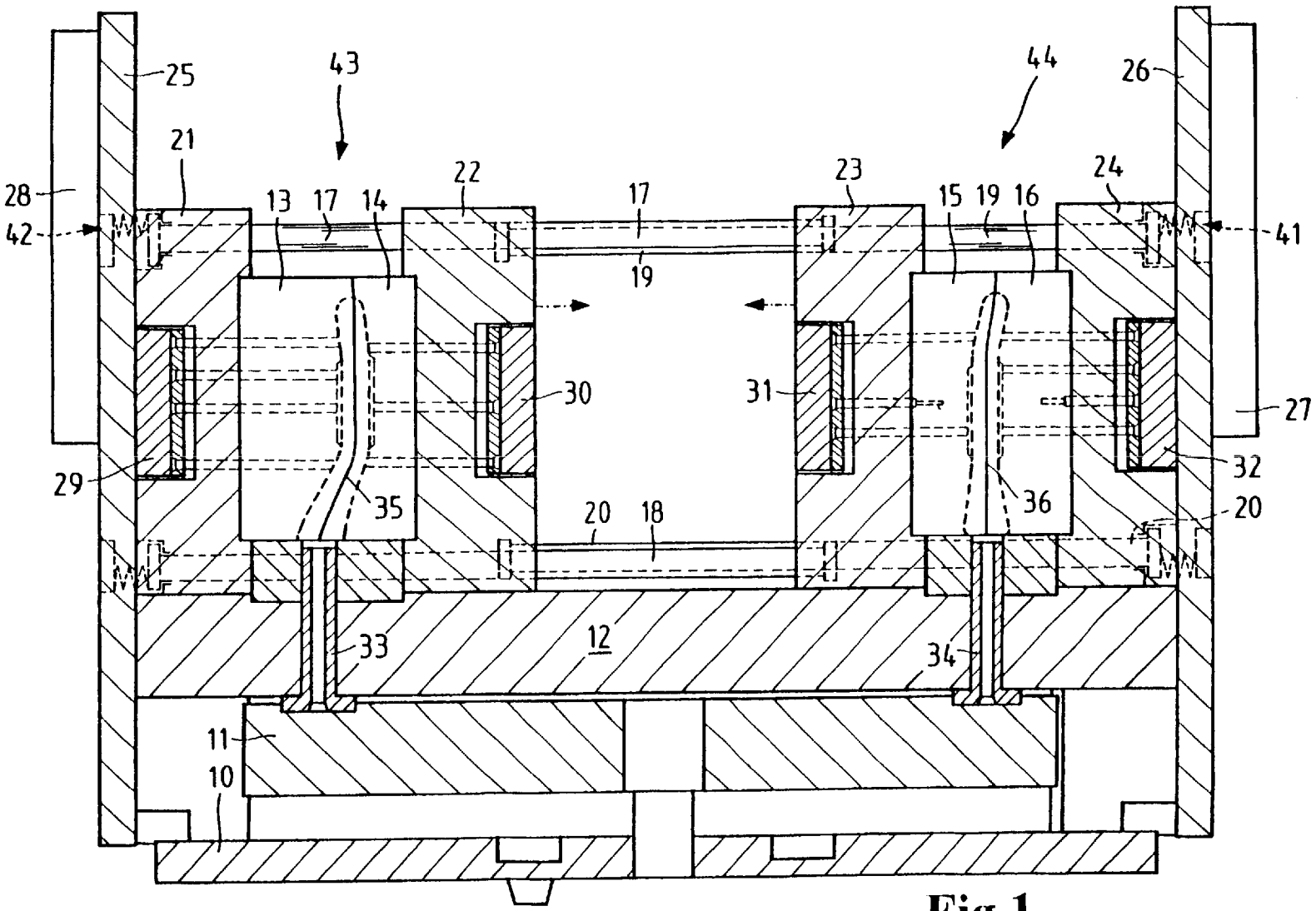
FIG. 1 shows a core casting tool in the closed state.

The core casting machine 2 of FIG. 1 comprises a support plate 10 which is fastened on a casting machine (not shown here). On this support plate 10 a casting distributor 11 is arranged with a tool carrier 12 fastened thereon. On the tool carrier 12 are the casting half-shells 13, 14, 15, 16, which are shown here in the closed state. The casting half-shell 13 is coupled to casting half shell 15 by connecting rods 17 and 18. The casting half-shell 14 is coupled with the casting half shell 16 by the connecting rods 19 and 20. The casting half-shells are fastened in corresponding tool holders 21, 22, 23, 24. The tool holders 21 and 24 are in turn arranged on supports 25 and 26. On these supports is a multiple coupler 27, 28, to carry the hydraulic lines and supply cooling fluid. Ejectors 29, 30, 31 and 32 are provided in the tool holders 21, 22, 23, 24.

The melt is introduced through the feeders 33 and 34 to the corresponding cavities 35 and 36. After the cast cores have solidified, the tools are opened.

Figure 2:
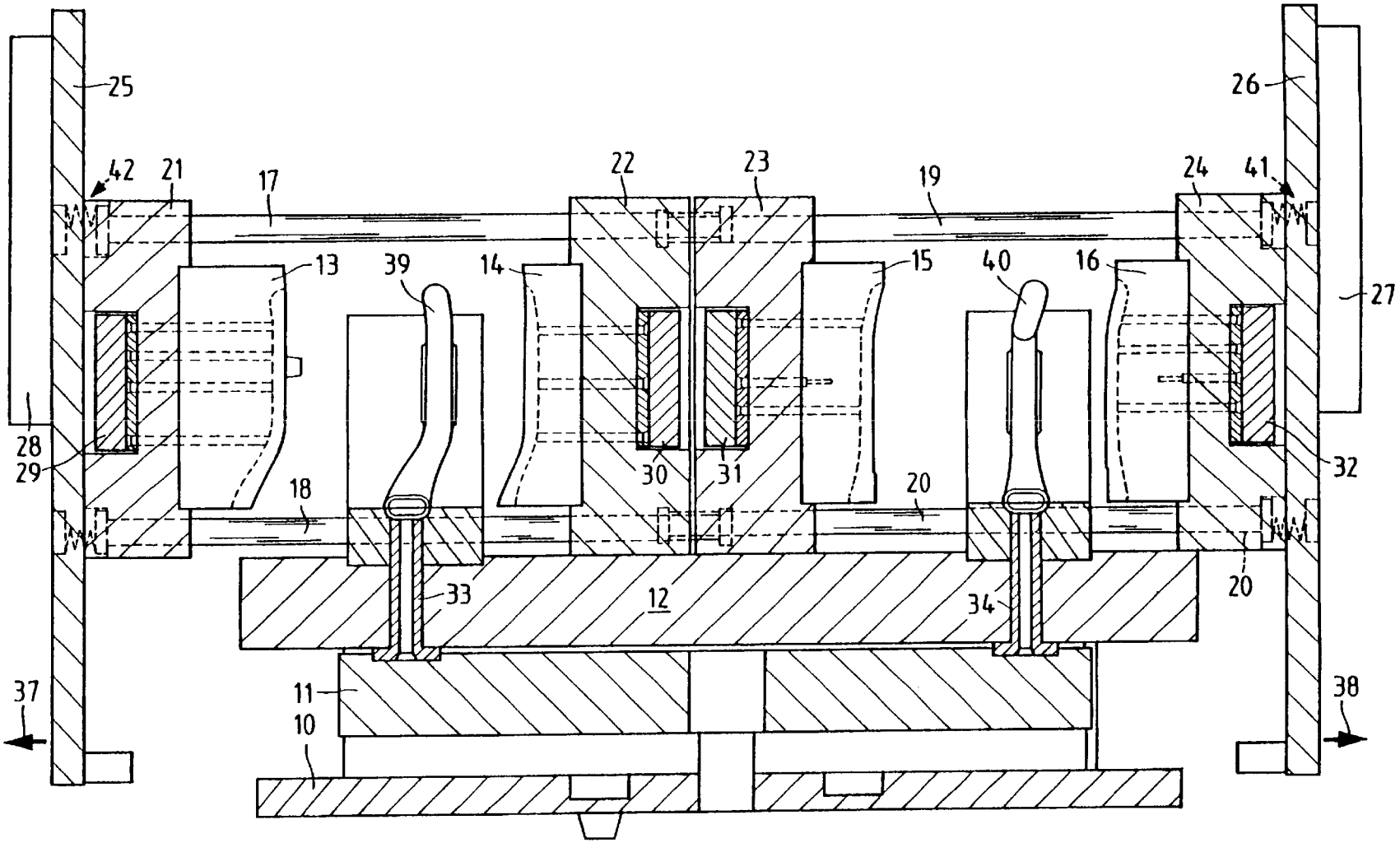
FIG. 2 shows a core casting tool in the open state.

In FIG. 2 the tools are shown in the opened state. Like parts are identified by the same reference numerals. Through movement of the supports 25 and 26 as indicated by the arrows 37 and 38, both half shells are separated from the cast cores due to the action of the connecting rods 17, 18, 19 and 20. After separation of the casting half-shells, the cores 39 and 40 are held on cylindrical projections on a base portion of the tool. The completed cores 39 and 40 then can be removed.

Figure 3:
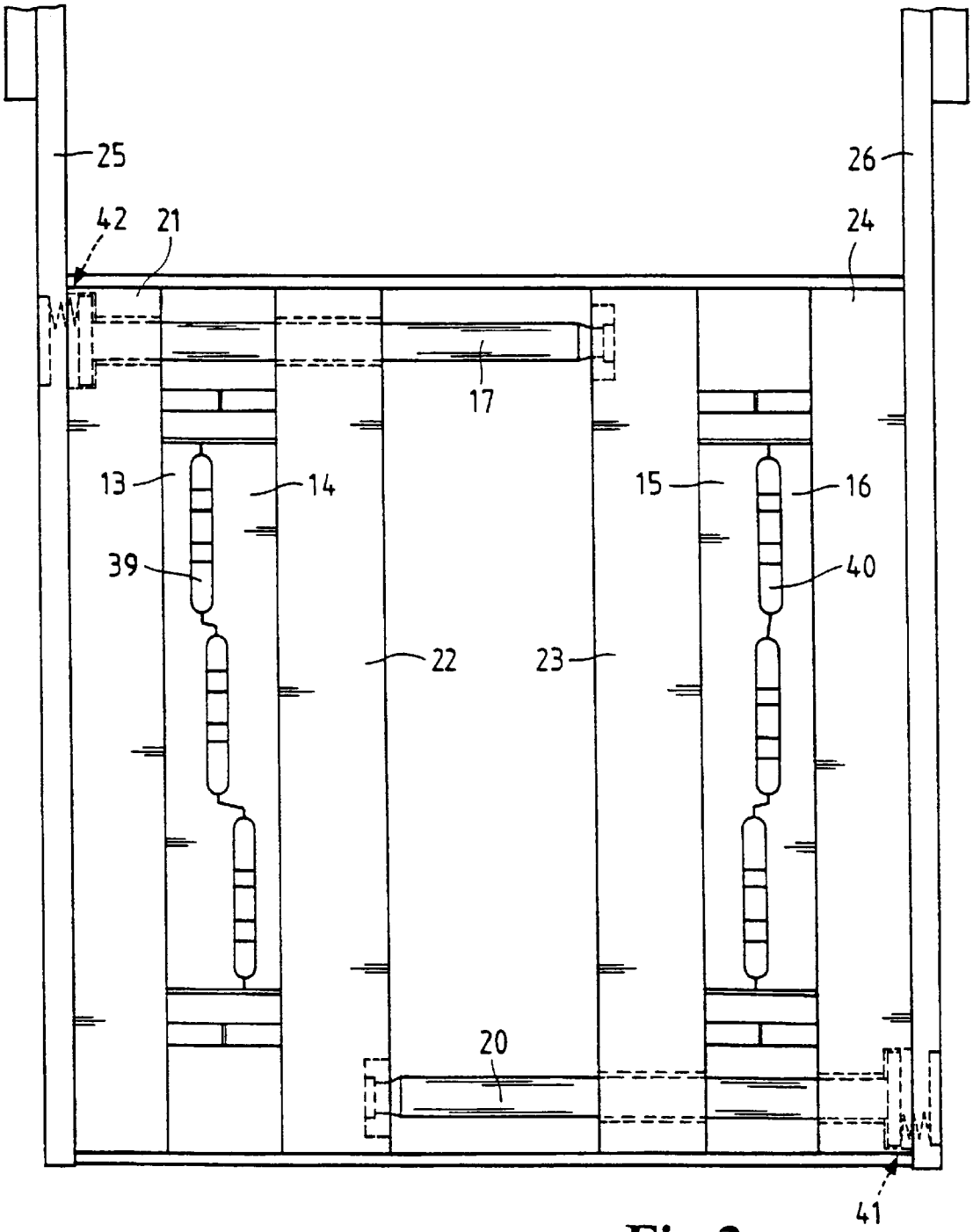
FIG. 3 shows a plan view of the core casting tool in the closed state.

FIG. 3 shows a plan view of the tool in the closed state. Here again, like parts are identified by the same reference numerals. The casting half-shells 13, 14, 15 and 16 are configured so that three cores can be cast simultaneously each time. The core planes are offset from one another and the connecting rods 17–20 are connected to the supports 25 and 26 with tolerance-equalizing spring packets 41 and 42 in order to compensate for machine tolerances or tolerances due to temperature fluctuations. In the representation depicted here, only the connecting rods 17 and 20 are shown, but of course the connecting rods 18 and 19 also may have tolerance-equalizing spring packets.

Figure 4:
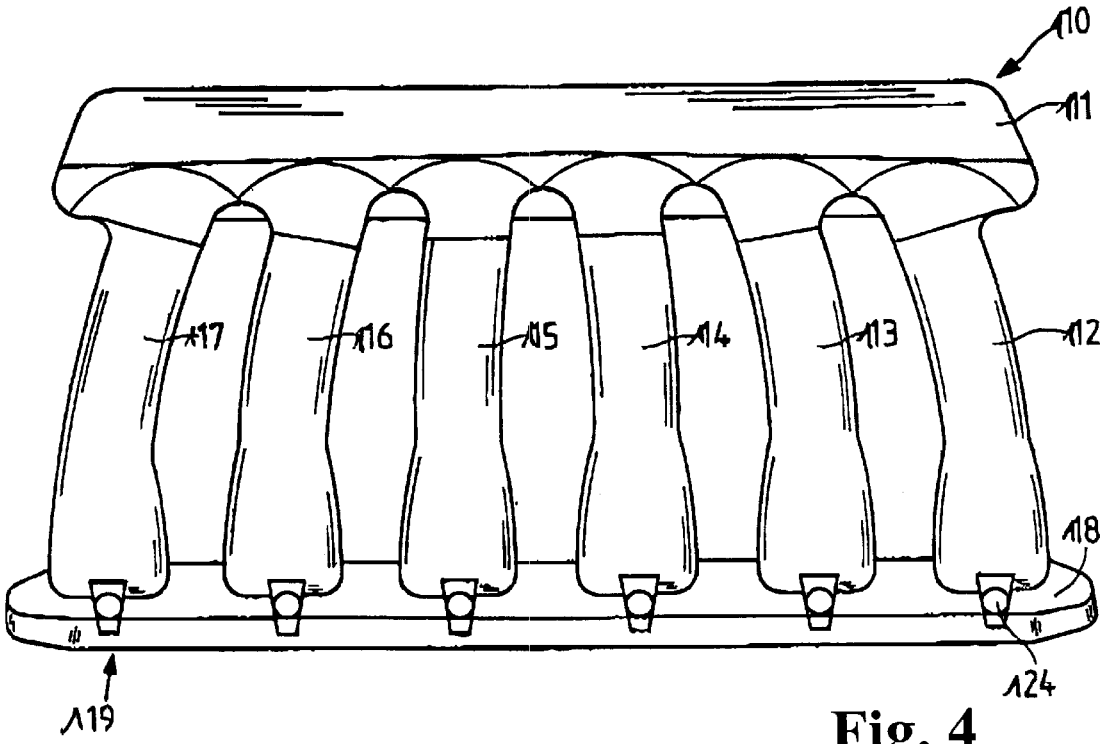
FIG. 4 shows an engine air intake tube which was produced by the melted core technique.

FIG. 4 shows an engine air intake manifold 110 for an internal combustion engine which is produced of thermoplastic synthetic resin material. The intake manifold 110 comprises an air collection chamber 111 to which filtered clean air is fed from a filter element, not shown here. From this air collecting chamber 111, individual intake tubes 112, 113, 114, 115, 116 and 117 extend to a connection flange 118, which interconnects the individual intake tubes. In the connection flange there are openings 119, 120, 121, 122, 134, 134 for injection nozzles, as well as mounting holes.

The first process step in the production of such an intake manifold are the manufacture of the core in a low-pressure process from a tin-bismuth alloy. This core is removed from the casting tool and placed in an injection molding machine. After the thermoplastic synthetic resin material has been injected around the core, the core is melted out and the plastic component is washed out. A core of this type for producing intake manifolds having six individual intake tubes weighs between 40 and 50 kg. This weight, of course, makes them difficult to handle.

Figure 5:
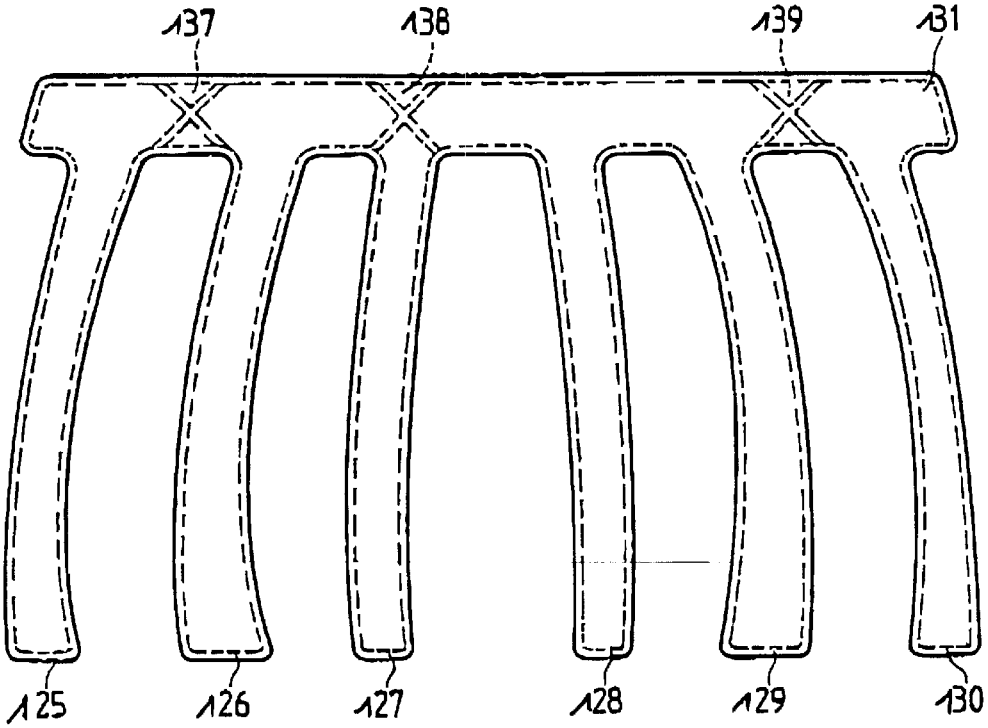
FIG. 5 shows a core composed of several half shells.

FIG. 5 shows a core for the intake manifold shown in FIG. 4. It includes six tubes 125, 126, 127, 128, 129 and 130, which are made by the half-shell technique, together with a collection chamber tube 131. The tubes 125 to 130 are attached to the collection chamber tube 131 by plug connections. FIG. 5 also shows internal structures 137, 138 and 139 for supporting the partial shells.

Figure 6:
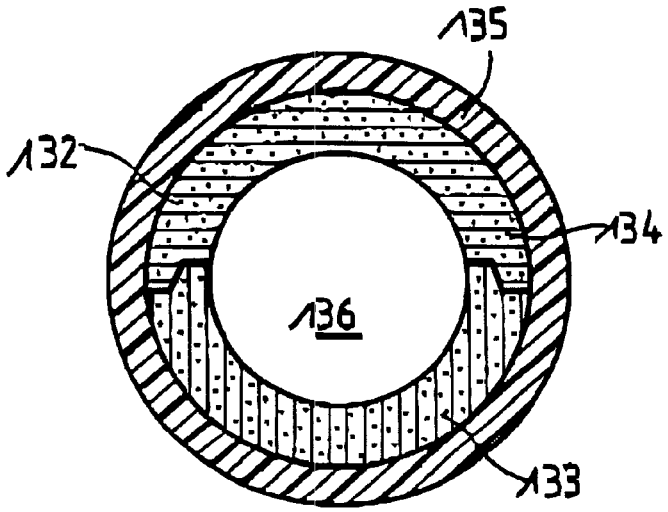
FIG. 6 shows a cross section through a half-shell core.

The structure of the cores is shown in FIG. 6. They are comprised of an upper half-shell 132 and a lower half-shell 133, which are interlocked or snapped together, for example, enclosing a hollow space 136. As previously mentioned, the cores have synthetic resin material 135 injected around them. This forms the intake manifold or the individual intake tubes in accordance with FIG. 4. Depending on their geometry, the half-shells 132 and 133 can be produced in a core casting machine, since the machines can be opened from both sides and a multi-stage tool can be used without additional expense.

Figure 7:
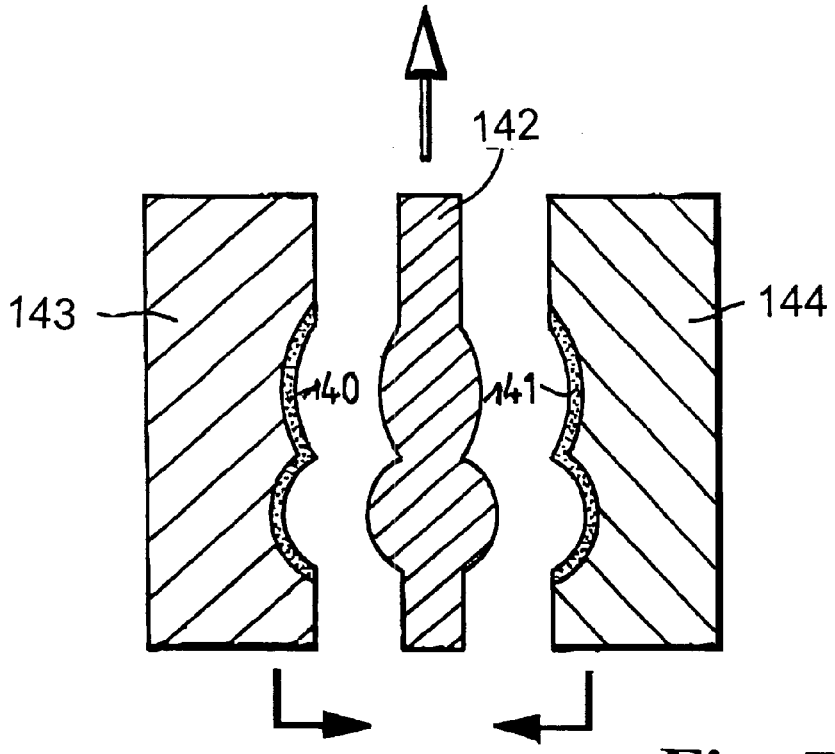
FIG. 7 shows a tool for the production of half shells.

In particular it is possible to carry out the process of press fitting the half-shells to each other in the core casting tool. For this purpose, as shown schematically in FIG. 7, the center plate 142 of the tool is removed and the two outer halves 143 and 144 are closed so that the half-shells 140, 141 can be interfitted together. Thus there is no need for an additional fitting device to join the half shells.

A significant advantage of the use of tubes as cores also is that, when the core is melted out, the melted fluid can pass into the core, which leads to a faster heat transfer and a faster melt-out.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A tool for producing casting cores which is arranged in a casting apparatus, said tool comprising a plurality of first casting half-shells and a plurality of second casting half-shells which mate with said first casting half-shells; wherein at least two parting planes are provided, and at least two movable casting units are provided, each casting unit being formed from a respective one of said first casting half-shells and a respective one of said second casting half-shells, and wherein the parting planes are arranged offset one behind the other in the direction of movement of said at least two casting units.

2. A tool according to claim 1, further comprising first connecting rods which connect the first casting half-shell of the first casting unit to the first casting half-shell of the second casting unit, and second connecting rods which connect the second casting half-shell of the first casting unit to the second casting half-shell of the second casting unit.

3. A tool according to claim 2, further comprising a tolerance-equalizing spring packet operatively associated with each of said connecting rods.

4. A tool according to claim 1, wherein each casting half-shell is equipped with at least one ejector.

5. A tool according to claim 1, wherein each casting unit is constructed for casting at least two cores.

6. A tool according to claim 1, further embodying a cylindrical projection connected to the base portion of the tool for holding the castings after separation of the casting half shells.

7. A tool according to claim 1, wherein the casting half shells will release the core on both sides when the casting half shells are open.

8. A tool according to claim 1, wherein the tool has a cavity shaped to form cores comprised of partial shells which can be assembled to each other before the core is placed in an injected molding tool and thermoplastic resin material is injected around it.

9. A tool according to claim 8, wherein the tool cavity is shaped to form the partial shells as half shells which surround a hollow cavity.

10. A tool according to claim 8, wherein a center plate positioned between the partial half-shells that is removable so that after casting the center plate can be removed to allow the partial shells to be assembled to each other by pressing or pinching them together in the core casting tool.

11. A tool according to claim 8, wherein the tool has a cavity shaped to form cores comprised of partial shells which can be assembled to each other before the core is placed in an injection molding tool and thermoplastic resin material is injected around it.

12. A tool according to claim 8, further comprising an internal structure for supporting the partial shells.

* * * * *